United States Patent [19]

Ettinger

[11] 4,319,362

[45] Mar. 16, 1982

[54] PROTECTIVE NECK APPARATUS

[76] Inventor: Donald N. Ettinger, 5310 Lance Dr., Knoxville, Tenn. 37919

[21] Appl. No.: 89,599

[22] Filed: Oct. 29, 1979

[51] Int. Cl.[3] ..... A42B 3/02

[52] U.S. Cl. ..... 2/415; 2/422

[58] Field of Search ..... 2/2, 9, 415, 421, 422, 2/185 R, 199; 128/76 R, 163, 164; 273/190 R, 190 A, 190 C

[56] References Cited

U.S. PATENT DOCUMENTS

| | | | |
|---|---|---|---|
| 2,774,601 | 12/1956 | White | 273/190 C |
| 3,148,375 | 9/1964 | Jones | 273/190 A |
| 3,166,761 | 1/1965 | Strohm | 2/421 |
| 3,189,917 | 6/1965 | Sims | 2/2 X |
| 3,497,872 | 3/1970 | Mitchell | 2/2 |
| 3,512,523 | 5/1970 | Barnett | 128/164 X |
| 3,555,561 | 1/1971 | Neis | 2/421 X |
| 3,591,863 | 7/1971 | Richard | 2/415 |
| 3,765,029 | 10/1973 | Germain | 2/2 |
| 3,855,631 | 12/1974 | Ettinger | 2/2 |
| 3,879,761 | 4/1975 | Bothwell | 2/415 |
| 4,094,015 | 6/1978 | Howard | 2/415 |
| 4,274,161 | 6/1981 | Littler | 2/415 X |

*Primary Examiner*—Louis Rimrodt

*Attorney, Agent, or Firm*—Jenkins, Coffey, Hyland, Badger & Conard

[57] ABSTRACT

Apparatus for protecting a wearer's neck against hyperflexion and hyperextension is employed in combination with protective head equipment and includes a pad removably carried by the protective head equipment for engaging a lower surface of a wearer's chin and a strap slidably received by the pad for securing the pad against the lower surface of the wearer's chin, the strap including an adjustable fastener for connection to the protective head equipment. Hyperflexion of the wearer's neck due to forward and downward movement of the wearer's head is limited when the pad is captured between the wearer's chin and chest. A second pad is removably carried by the protective head equipment for engaging the wearer's neck at the base of the wearer's head to protect the wearer against hyperextension of the wearer's neck due to backward movement of the wearer's head.

13 Claims, 4 Drawing Figures

PROTECTIVE NECK APPARATUS

The present invention is related to protective neck equipment, and more particularly, to apparatus for limiting forward and backward movement of a wearer's head which is employed in combination with protective head equipment.

Injuries to athletes who participate in contact sports such as football are statistically on the increase. Numerous articles have recently appeared in sports publications discussing this increase in sports-related injuries, and many of these articles have expressed concern for the number of injuries related to the sport of football. While considerable protective equipment is already worn by athletes participating in the sport of football, it has been observed that while this protective equipment protects the wearer, it may also be used to inflict injury. Further, even when wearing the protective equipment, some areas of the wearer's body remain exposed and therefore subject to injury. One example of an exposed area is the neck. Serious injuries such as brain and spinal cord damage can result from hyperflexion and/or hyperextension of the neck. These conditions usually occur as the result of a player's head being forced backward or forward and downward. These types of forces to the player's head can occur any time during the course of an athletic event; however, neck injuries frequently occur where two players are mismatched and a stronger bigger player is able to control the head of a smaller player, e.g., in blocking and tackling.

While football players typically wear protective head equipment or a helmet to protect the head, such equipment does not limit the forward and downward or backward movement of the head resulting from forces applied to the player's head. Players also typically wear protective shoulder equipment to protect the player's shoulders and chest; however, this equipment also does not limit hyperflexion or hyperextension of the player's neck. Various collars for supporting the back of the player's neck and for therefore limiting backward movement of the player's head in response to forces being applied to the front of the head have been developed and used in the sport of football. However, most of these neck collars are open in the front so that the player's chin can still come into contact with the player's chest and hyperflex the player's neck. See, for example, U.S. Pat. Nos. 3,189,917 and 3,497,872.

In my U.S. Pat. No. 3,855,631, issued Dec. 24, 1974, I disclose a protective neck collar which extends circumferentially about a player's neck between protective shoulder equipment and the player's head. While my previous protective neck collar is intended to protect the wearer against injury due to extreme neck flexion in any direction, it is connected to the protective shoulder equipment.

There is further disclosed in U.S. Pat. No. 3,765,029 a head-restraining device for use in combination with protective shoulder equipment to protect a wearer of the protective shoulder equipment against neck injury resulting from forward and downward movement of the head of the wearer beyond a predetermined lower position.

According to the present invention, one feature is to provide protective neck apparatus for use in combination with protective head equipment of the type generally worn by athletes who participate in such sports as football.

A further feature of the present invention is to provide protective neck apparatus as described above including a cylindrical pad removably carried by the protective head equipment for engaging a lower surface of the wearer's chin and means slidably received by the pad for securing the pad beneath the lower surface of the wearer's chin having at least one adjustable fastener for connection to the protective head equipment. The pad resting beneath the wearer's chin is captured between the wearer's chin and chest to thereby limit forward and downward movement of the wearer's head and protect against hyperflexion of the wearer's neck.

Yet another feature of the present invention is to provide protective neck apparatus for limiting both flexion and extension of a wearer's neck, including a helmet, a first pad removably carried by the helmet and secured beneath the wearer's chin for limiting forward and downward movement of the wearer's head, and a second pad removably carried by the helmet and secured against the back of the wearer's neck for limiting backward movement of the wearer's head. Each pad is independently fastened to the helmet using quick disconnect fasteners so that the pads may be easily and quickly removed from the helmet.

A helmet constructed in accordance with the present invention includes a generally spherical cavity worn over a wearer's head and a chin-engaging means removably fastened to the cavity for securing the cavity to the wearer's head. The means for securing the cavity to the wearer's head includes two interconnected straps, one strap carrying a cup positionable over the wearer's chin and the other strap carrying a pad positionable beneath the wearer's chin for limiting forward and downward movement of the wearer's head. The two straps each include fasteners which are variably positionable with respect to the ends of the straps for adjustably connecting the securing means to the cavity. Accordingly, the chin-engaging means is adaptable to various sizes of helmets and comprises, as a single unit, two interconnected straps, a cup engaging the wearer's chin, and a pad engaging a lower surface of the wearer's chin.

In accordance with the present invention and the features described above, the pad positioned beneath the wearer's chin cooperates with protective shoulder equipment, which may also be worn by the wearer, to prevent the wearer's head from turning side-to-side when the pad engages the protective shoulder equipment. The pad engaging the lower surface of the wearer's chin is captured between the wearer's chin and the protective shoulder equipment, and the pad engaging the back of the wearer's neck is captured between the protective head and shoulder equipment. Accordingly, when the wearer's head is moved forward and downward, such movement is limited by a first pad engaging the protective shoulder equipment, and when the wearer's head is moved backward, such movement is limited by a second pad engaging the protective shoulder equipment.

While various features of the present invention have been described above, other features and advantages of the present invention will become apparent from the following detailed description of an embodiment thereof, which description should be considered in conjunction with the accompanying drawings in which.

Figure 1:
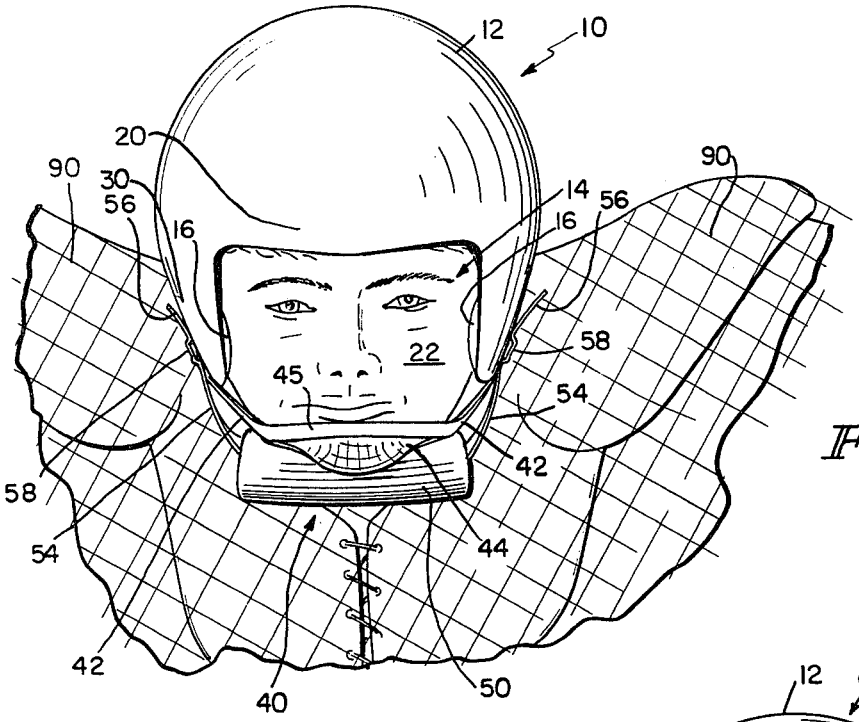
FIG. 1 is a front view of the protective neck apparatus of the present invention illustrating its adaptation to a wearer.
Figure 4:
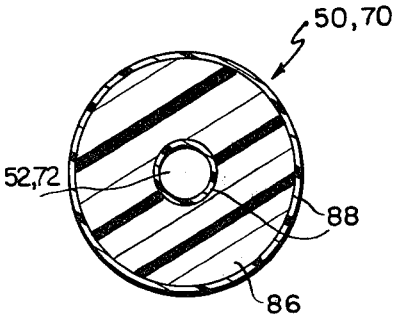
Figure 2:
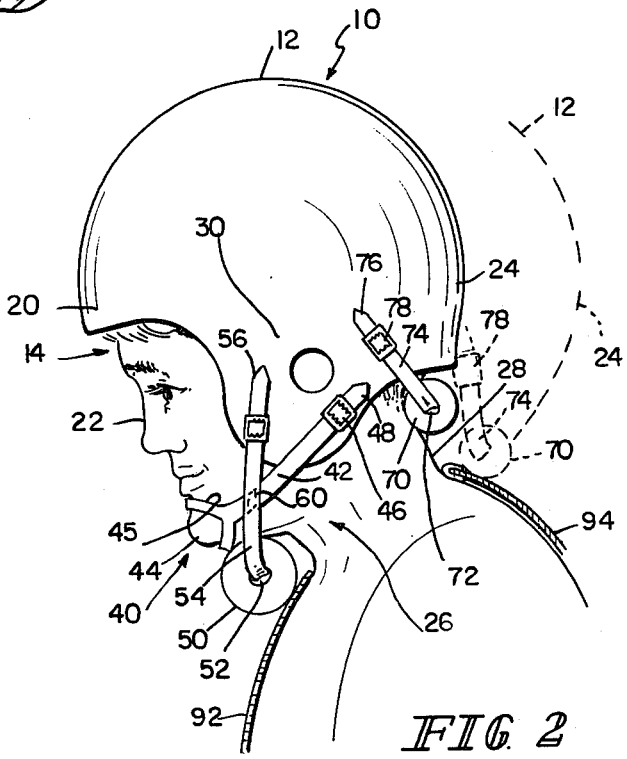
FIG. 2 is a side view of the apparatus of FIG. 1 further illustrating its adaptation to a wearer.
Figure 3:
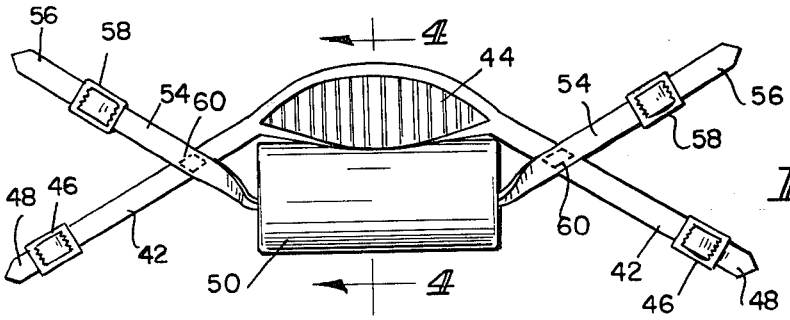

FIG. 3 is a front elevational view of a fragment of the apparatus of FIGS. 1 and 2; and FIG. 4 is a partial cross-sectional view of the fragment of the apparatus of FIGS. 1 and 2 shown in FIG. 3 taken generally along section lines 4—4.

Referring now to FIG. 1, protective head equipment 10, commonly referred to as a helmet, which is worn by athletes who participate in body contact sports such as football, generally includes a spherical cavity 12 positionable over the wearer's head 14. The helmet 10 is typically constructed of polycarbonate, styrene, and leather, and honeycombed with pods 16 of rubber or foam to protect and cushion the wearer's head 14 against severe blows to the head. The helmet 10 will further include a front portion 20 cut-away for exposure of the wearer's face 22 and a rear portion 24 cut-away for exposure of the wearer's neck 26 and back of the neck 28 below the base of the head 14. A face mask (not shown) comprising one or more bars across the front portion 20 of the helmet 10 is typically provided to protect the wearer's exposed face 14. Intermediate the front portion 20 and the rear portion 24 is a portion 30 providing protection for the wearer's ears (not shown). Unfortunately, such protective head equipment 10 does not shield or protect the neck area 26 and therefore serious neck injuries, due primarily to extreme flexing or stretching of the cervical spine and neck muscles, can occur in the absence of a protective neck device.

Also associated with the helmet 10 is means 40 for securing the cavity 12 to the wearer's head 14 including a strap 42. The securing means 40 is typically fastened to the sides of the helmet 10 at the intermediate portion 30 and engages the chin 45 of the wearer to secure the helmet 10 to the wearer's head 14. The strap 42 includes a cup 44 for engaging the chin 45 and fasteners 46 at each end 48 of the strap 42, at least one of which is variably positionable with respect to one end 48 of the strap 46 for adjustment so that the strap 42 is adaptable to various sizes of helmets 10.

While prior protective neck devices have included U-shaped rolls which are worn around the rear and the sides of a wearer's neck and kept in place by tying to the wearer's protective shoulder equipment in the front and/or the rear, the protective neck apparatus of the present invention is carried by and secured to the protective head equipment 10 and a front protective neck apparatus is formed as an integral part of the securing means 40.

Means for limiting forward and downward movement of a wearer's head 14 includes a cylindrical pad 50 having a length of 5 inches, a diameter of 2 inches, and a ⅜ inch diameter aperture 52 formed axially through the center of the cylindrical pad 50. The cylindrical pad 50 is secured beneath the wearer's chin 45 by a strap 54 having ends 56. Each end 56 of the strap 54 includes a fastener 58 and at least one of the fasteners 58 is variably positionable with respect to one of the ends 56 for adaptation to the various sizes of helmets 10. The strap 54 is slidably received within the aperture 52 of the cylindrical pad 50 so that the pad 50 is movable in relation to the strap 54 and is connected at a point 60 to the strap 52 normally employed to secure the helmet 10 to the wearer's head 14. According to the present invention, the securing means 40 includes straps 42, 54; chin cup 44; and the cylindrical pad 50 and is connected to the helmet 10 at four points located on the intermediate portion 30 of the helmet 10, as best illustrated in FIG. 2, the connection of strap 54 being forward of the connection of strap 42. When the wearer's head is bent forward and downward, the cylindrical pad 50 engages the wearer's chest to limit the forward and downward movement of the wearer's head 14 to thereby protect the wearer against hyperflexion of the neck 26. It should be noted that when the securing means 40, including the pad 50, is fastened to the helmet 10, the pad 50 is secured beneath the lower surface of the wearer's chin 45 and cannot be pulled out from under the chain 45. Further, the pad 50 presents no impairment to the wearer's ability to turn his head 14 or to the wearer's peripheral vision.

The design of the cylindrical pad 50 and the straps 42, 54 is such that the pad 50 is secured beneath the wearer's chin 45, extends outward under the wearer's jaws, and does not rest or contact the wearer's larynx. It should be noted that the angle of the chin strap 42 has been decreased from the conventional chin strap to limit movement of the cup 44 and prevent movement of the pad 50. It should also be noted that the strap 54 is generally vertical so that the pad 50 is secured against the wearer's chin. Further, the pad 50 is prevented from resting on the wearer's larynx by the interconnection and fastening scheme of the two straps 42, 54.

Means for limiting backward movement of the wearer's head include a cylindrical pad 70 having a length of 5 inches, a diameter of 1½ inches, and a ⅜ inch aperture 72 formed axially through its center. A strap 74 is slidably received in the aperture 72 so that the pad 70 is movable relative to the strap 74 and includes ends 76. Fasteners 78 are carried by the ends 76 of the strap 74 for connecting the strap 74 to the helmet 10 and for securing the cylindrical pad 70 to the back 28 of the wearer's neck 26 immediately below the base of the wearer's head 14. Again, at least one of the fasteners 78 is variably positionable with respect to one of the ends 76 of the strap 74 for adaptation to various sizes of helmets 10. As illustrated by the broken lines in FIG. 2 when the wearer's head is forced backward, the cylindrical pad 70 is captured between the rear portion 24 of the helmet 10 and the wearer's back to thereby limit backward movement of the wearer's head 14 and prevent hyperextension of the wearer's neck 26.

Turning to FIG. 4, the cylindrical pads 50, 70 are preferably constructed of a soft closed-cell material 86 being rigid enough to limit movement of the wearer's head 14 and yet flexible enough to cushion the wearer's chin 45 and the back of the wearer's neck 26. In one embodiment, the pads 50, 70 may include a vinyl coating 88 to increase the strength of the pads 50, 70 and at the same time provide smoothness to the wearer's skin.

In many body contact sports such as football, the player will also wear protective shoulder equipment 90, as best illustrated in FIG. 1. As further illustrated in FIG. 2, such protective shoulder equipment 90 will typically include a breast or chest plate 92 and a back plate 94. In accordance with the present invention, these plates 92, 94 provide surfaces for engaging the pads 50, 70 when the wearer's head 14 is moved forward and downward or backward. Referring to FIG. 2, when the wearer's head 14 is moved forward and downward, the cylindrical pad 50 is captured between the wearer's chin 45 and the breast plate 92 to thereby limit the forward and downward movement of the wearer's head 14. Further, when the wearer's head is moved backward, the cylindrical pad 70 is captured between the rear portion 24 of the helmet 10 and the back plate 94 of the protective shoulder equipment 90 to thereby limit backward movement of the wearer's head 14.

By referring to FIG. 1, it can also be appreciated that when the cylindrical pad 50 is engaging the breast plate 92 the cylindrical pad 50 blends in with the protective shoulder equipment 90 and in fact is held in position by the protective shoulder equipment 90 to thereby also limit sideward movement of the wearer's head 14. Furthermore, when the player is in the blocking or tackling position, the pad 50 in conjunction with the helmet 10 and the protective shoulder equipment 90 hold the player's head 14 and neck 26 in a secured position to protect against forward, backward, and sideward movement of the head 14. Accordingly, in combination with a conventional helmet 10, the protective neck apparatus of the present invention limits forward and downward movement, backward movement, and sideward movement of the wearer's head 14 to protect the wearer's neck against extreme flexing or stretching in any direction.

What is claimed is:

1. In a protective head apparatus of the type worn by athletes having a generally spherial shaped shell with a cavity for receiving a wearer's head, cut-away portions for exposing the wearer's face and neck, and a chin strap for securing the shell to the wearer's head, the improvement comprising means removably carried by the protective head apparatus for limiting forward and downward movement of the wearer's head to protect the wearer from hyperflexion of the neck, the limiting means including a generally cylindrical-shaped pad constructed of a flexible material and another strap for securing the pad against a surface beneath the wearer's chin, the chin strap and the other strap being connected to form a single chin-engaging unit, and means for removably fastening the chin-engaging unit to the shell.

2. The improvement as recited in claim 1 wherein the straps forming the chin-engaging unit are crossed so that the strap for securing the pad against the surface beneath the wearer's chin is fastened to the shell forward of the strap for securing the shell to the wearer's head.

3. The improvement as recited in claim 1 wherein the pad is captured between the surface beneath the wearer's chin and chest in response to forward and downward movement of the wearer's head to limit such movement of the head.

4. The improvement as recited in claim 3 further comprising a second pad carried by the protective head apparatus for engaging the wearer's neck at the base of the wearer's head and a strap for securing the second pad against the wearer's neck, the strap for securing the second pad including fastener means for connection to the shell, whereby hyperextension of the wearer's neck due to backward movement of the wearer's head is limited by the second pad.

5. The improvement as recited in claim 4 wherein the second pad is captured between the shell and the wearer's shoulders to limit backward movement of the wearer's head and thereby protect the wearer from hyperextension of the neck.

6. The improvement as recited in claim 5 wherein the second pad is generally cylindrical-shaped and constructed of a flexible material.

7. The improvement as recited in claim 6 wherein the pads are constructed of a closed-cell material and are coated with a vinyl material to provide strength and a smooth outer surface.

8. The improvement as recited in claim 6 wherein each pad includes an aperture provided generally axially through the center of the pad for receiving one of the straps and allowing axial movement of the pad relative to the strap.

9. The improvement as recited in claim 8 wherein each strap includes fasteners located at both of its ends, at least one of which is variably positionable with respect to one end of the strap for adaptation to various sizes of protective head equipment.

10. In a helmet comprising a generally spherical shell having a cavity for receiving a wearer's head and a chin-engaging means removably fastened to the shell for securing the shell to the wearer's head, the chin-engaging means including two interconnected straps, a first strap carrying a cup for engaging the wearer's chin, first means located rearwardly on the shell for fastening the first strap to the shell to secure the shell to the wearer's head, the improvement comprising a second strap carrying a pad for engaging a surface beneath the wearer's chin and for limiting forward movement of the wearer's head, the pad having a generally cylindrical shape and being constructed of a flexible material, and second means located forward of the first fastening means on the shell for fastening the second strap to the shell to secure the pad against the surface beneath the wearer's chin.

11. Protective apparatus for use with protective head equipment comprising a first cylindrical pad carried by the protective head equipment for engaging a surface beneath a wearer's chin, a first strap passing axially through the first pad and allowing movement of the first pad relative thereto so that the first pad is carried generally intermediate the ends of the first strap, a second cylindrical pad carried by the protective head equipment for engaging the wearer's neck at the base of the wearer's head, a second strap passing axially through the second pad and allowing movement of the second pad relative thereto so that the second pad is carried generally intermediate the ends of the second strap, and quick-disconnect fasteners provided at both ends of the straps and to both sides of the protective head equipment for removably connecting the straps to the protective head equipment, the first pad being captured between the surface beneath the wearer's chin and the wearer's chest to limit forward and downward movement of the wearer's head, thereby to protect the wearer from hyperflexion of the neck, the second pad being captured between the protective head equipment and the wearer's shoulders to limit backward and downward movement of the wearer's head, thereby to protect the wearer from hyperextension of the neck.

12. The apparatus as recited in claim 11 further comprising a chin strap having a chin cup provided for engaging the wearer's chin to secure the protective head equipment to the wearer's head, the chin strap including the first limiting means.

13. The apparatus as recited in claim 12 wherein the chin strap, chin cup, first cylindrical pad, and the first strap for securing the first pad beneath the wearer's chin comprise a single chin-engaging unit which is removably fastened to the protective head equipment at four points.

* * * * *